United States Patent [19]

Mayerjak

[11] 4,297,937

[45] Nov. 3, 1981

[54] ARM AND KEY BED ASSEMBLY FOR A PIANO AND THE LIKE

[75] Inventor: Robert J. Mayerjak, Torrington, Conn.

[73] Assignee: Currier Piano Company, Inc., Marion, N.C.

[21] Appl. No.: 77,851

[22] Filed: Sep. 21, 1979

[51] Int. Cl.[3] ..... G10C 3/04

[52] U.S. Cl. ..... 84/430; 84/177; 84/452 R

[58] Field of Search ..... 84/177, 193, 250, 352, 84/184–186, 430–434, 452, 80, 438–440, 176

[56] References Cited

U.S. PATENT DOCUMENTS

| | | | |
|---|---|---|---|
| 389,436 | 9/1888 | Bent | 84/176 |
| 1,618,521 | 2/1927 | Eilert | 84/186 |
| 2,081,704 | 5/1937 | Heller | 84/184 |
| 2,191,443 | 2/1940 | Day et al. | 84/180 |
| 3,487,737 | 1/1970 | Miyazima | 84/177 |

*Primary Examiner*—Lawrence R. Franklin

*Attorney, Agent, or Firm*—McCormick, Paulding & Huber

[57] ABSTRACT

A piano case or frame includes a laminated key bed and side arms joined with the bed at each end. The key bed supports the keyboard and associated portions of the piano action, and is assembled with each side arm of the frame by means of a rabbet joint. Fastening screws extending through the laminated bed into barrel nuts within each of the side arms develop significant pressure in the rabbet joints to hold the key bed and the supported keyboard in a level, undistorted position.

8 Claims, 7 Drawing Figures

ARM AND KEY BED ASSEMBLY FOR A PIANO AND THE LIKE

BACKGROUND OF THE INVENTION

The present invention relates to pianos, organs, harpsichords and like instruments which have a keyboard for playing the instrument. In particular, the invention is concerned with the assembly of a side arm of the instrument frame and the key bed that supports the keyboard of the instrument.

The side arms and key bed of pianos and the like are connecting structural members which form a front portion of the piano case or frame. The key bed is connected at each end to the respective side arms of the piano and has an upper surface on which the keyboard of the instrument is mounted. Since the key bed supports the keys, their hinges, stops and associated portions of the piano action, any warpage of the bed can interfere with the regulation that establishes identical function aand timing of the keys and their actions with the strings. Warpage may totally prevent operation of the individual keys, and even slight distortions can cause the response to depression of one or more keys to be so significantly degraded that satisfactory performance is impossible.

In my co-pending application Ser. No. 077,150 filed Sept. 19, 1979 and entitled Key Bed For A Piano Or The Like, a laminated key bed construction is disclosed which utilizes outer laminates of sheet metal and an intermediate material such as particleboard or fiberboard. This laminated key bed construction utilizes the high modulus of metal to improve the stiffness of the bed and correspondingly reduce warpage.

The novel structure of my improved bed is not particularly suited to attachment with the side arms of the piano in accordance with prior art techniques. In the prior art the key bed is formed from laminated hard woods and is attached to the side arms by means of toed screws which are driven upwardly through the key bed into the arm as shown in FIG. 5 of this application. Tightening the toed screws causes severe local stressing of the key bed in the region surrounding the screw, and can cause local failure or loosening of the joint which is undesirable. This problem is particularly pronounced in reconstituted wood materials such as the particleboard or fiberboard.

It is accordingly a general objection of the present invention to provide an improved assembly of the side arm and key bed in a piano or like instrument.

SUMMARY OF THE INVENTION

The present invention resides in an arm and key bed assembly in a piano or like instrument having a keyboard for playing the instrument.

The assembly includes a laminated key bed having an upper bed surface on which the keyboard of the instrument is mounted. The bed also has a parallel lower surface, and in one embodiment the key bed has sheet metal laminates defining both the upper and the lower surfaces.

The assembly further includes an arm of the piano case joined with one end of the key bed at one side of the piano. The arm includes a shelf against which one of the upper or lower surfaces of the bed rests for alignment and positioning. For example, one end of the key bed may fit in a rabbet groove defining the shelf in the arm with the upper or lower surface of the bed resting on the shelf. When the shelf and the surface of the bed are held in contact, the arm and the bed are drawn into perpendicular relationship.

A nut is mounted within the arm at a position spaced from the shelf and the axis of the hole through the nut intersects the shelf in generally perpendicular relationship. Connected in threaded engagement with the nut is a threaded fastening member which extends through the laminated key bed and the arm generally perpendiclar to the shelf. For example, a threaded fastening member in the form of a screw extends through the laminated key bed into the arm and draws the mating surfaces of the bed and shelf into clamping engagement and perpendicular alignment when tightened.

In one form of the invention, the nut is a barrel nut inserted in an access hole of the arm. When the screw is tighten, significant pressure at the interface of the shelf and the mating surface of the bed is developed, and with a plurality of such screws distributed along the mating surfaces of the shelf and the bed, the clamping pressures prevent warping and distortion of the bed.

DESCRIPTION OF THE PREFERRED EMBODIMENTS

Figure 1:
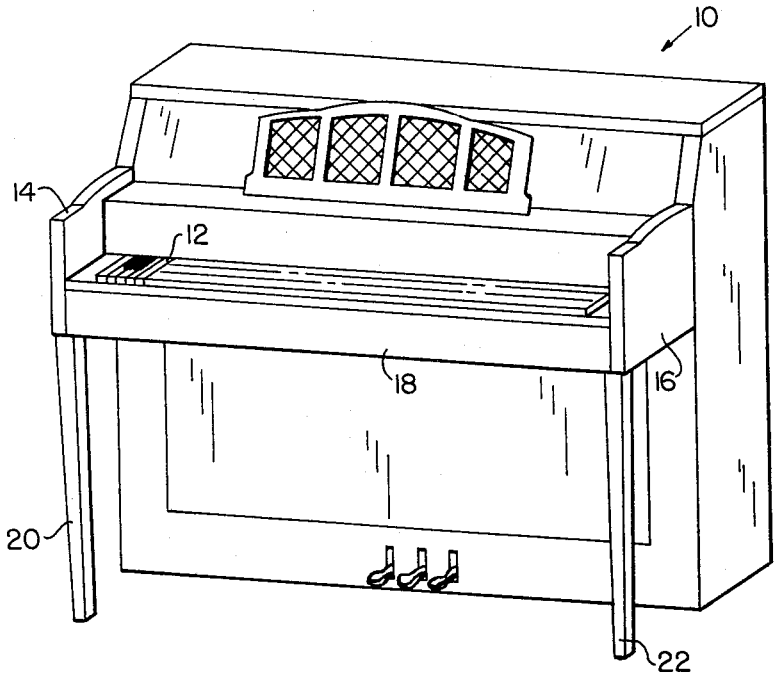
FIG. 1 is a perspective view of a piano in which the present invention is incorporated.

FIG. 1 illustrates a piano in which the arm and key bed assembly of the present invention is incorporated. The piano, generally designated 10, is one instrument in which the invention may be utilized, but the invention can be used with equal facility in organs, harpsichords and other instruments having keyboards that are manipulated to play the instrument. The keyboard is shown with a plurality of keys 12 supported between the arms 14 and 16 at each side of the piano. The key bed on which the keyboard is mounted is not visible since the bed is covered by the keys on top, the key slip 18 at the front and the arms 14 and 16 at each end.

Figure 2:
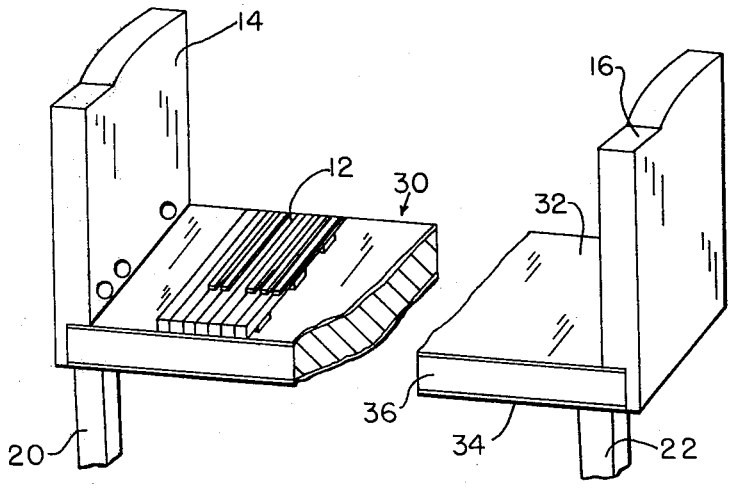
FIG. 2 is a perspective view of the key bed and arm assembly of the present invention with the midportion of the bed broken away to show its laminated structure.

FIG. 2 illustrates the assembly of the piano arms 14 and 16 and the key bed 30 with the surrounding portions of the piano removed for clarity. The arms and key bed form the main structure of the piano frame or case at the front of the piano, and the bed serves as the mount for not only the keyboard but also the case legs 20 and 22 at each end of the bed. As the structural platform supporting the keyboard with the keys and portions of the respective actions, the key bed must resist warping and distortion that interferes with the regulation of the keys and actions.

In accordance with the invention defined more particularly in my co-pending application Ser. No. 077,150 referenced above, the keyboard 30 has a laminated construction which includes an upper sheet metal laminate 32, a lower sheet metal laminate 34 and an intermediate laminate of a reconstituted wood product such as particleboard or fiberboard. The laminates are bonded together with settable compounds such as acrylic or epoxy resins. This laminated construction exhibits a high degree of stiffness due to the metal laminates at the outer surfaces of the bed. For a more detailed description of the laminated structure, reference may be had to my co-pending application.

Figure 3:
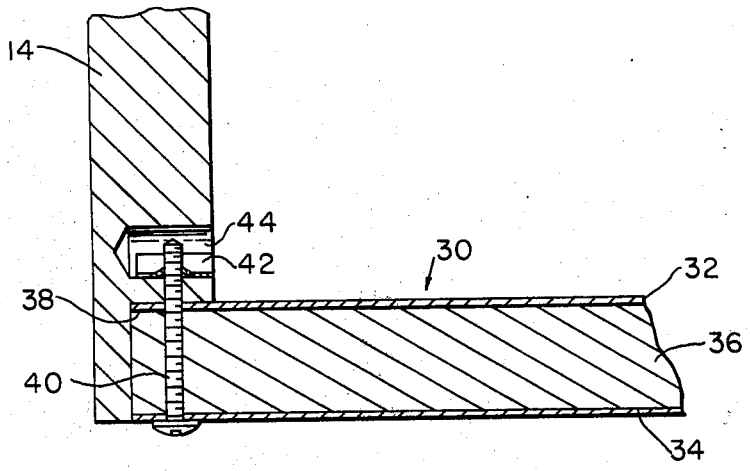
FIG. 3 is a fragmentary cross-sectional view of the key bed and arm assembly of the present invention at one of the fastening screws.
Figure 5:
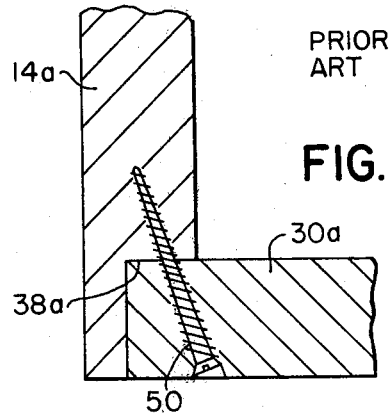
PRIOR ART FIG. 5
FIG. 5 is a fragmentary cross-sectional view of an arm and key bed assembled as in the prior art.
Figure 4:
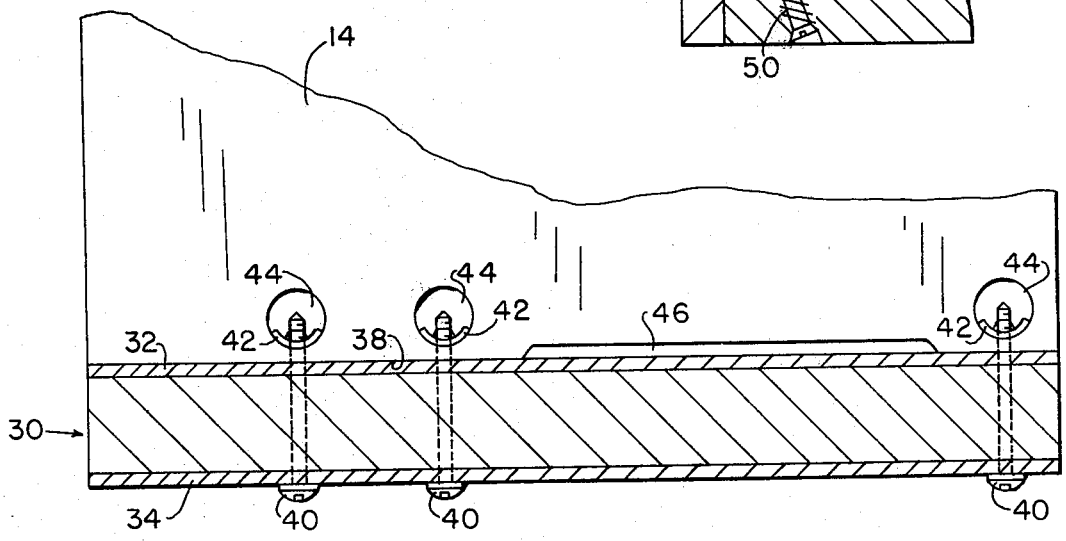
FIG. 4 is a fragmentary view of the key bed and arm assembly with the key bed in section.

The assembly of the arm 14 and key bed 30 in accordance with the present invention is illustrated in detail in FIGS. 3 and 4 which may be compared with the prior art assembly of a side arm 14*a* and bed 30*a* illustrated in FIG. 5.

The cross-sectional view of the novel assembly in FIG. 3 illustrates a rabbet joint formed between the side arm 14 and the bed 30 in a manner similar to the prior art structure of FIG. 5. The lower edge of the side arm 14 has a rabbet groove which forms a shelf 38 against which the upper surface of the bed 30 rests. To hold the arm and bed in assembled condition, a threaded fastening member such as a sheet metal screw 40 extends upwardly through the laminated bed and the arm generally perpendicular to the shelf 38 in threaded engagement with a barrel nut 42 mounted within an access hole 44 at one side of the arm 14. The screw and barrel nut draw the upper surface of the bed and the confronting surface of the shelf 38 into clamping engagement and apply significant pressure between the clamped surfaces to establish perpendicular alignment of the arm and bed. As shown in FIG. 4 a plurality of screws 40 and barrel nuts 42 may be distributed along the one end of the bed and the arm 14 to prevent warping and distortion of the bed and to maintain the level of the bed through the clamping pressures at the mating surfaces. If desired increased pressures at the interface of the bed and the arm may be provided by undercutting the shelf 38 as indicated at 46.

In the prior art assembly shown in FIG. 5 a plurality of toed screws 50 extend upwardly through the bed 30*a* into the side arm 14*a* to establish clamping pressure between the shelf 38*a* of the arm and the upper surface of the bed 30*a* in a manner similar to Applicant's assembly of FIGS. 3 and 4. However, the amount of clamping pressure that can be developed by the screws 50 is limited by the angle of the toed screw and the force that can be developed between the screw and the wood immediately adjacent the screw. In comparison, Applicant's screw and nut combination can carry significantly higher forces and react those forces through the interface of the shelf and the bed due to the metal-to-metal engagement established by the screws 40 and nuts 42 and the distribution of those forces in the arm by means of the barrel nut 42 and into the bed 30 by means of the head of the screw 40. The invention is particularly advantageous with my improved laminated key bed in which the upper and lower laminates of the bed are sheet metal. The metal in appropriate thicknesses is capable of withstanding the high compressive forces of the screw head without collapsing the metal initially or with aging of the parts. If desired or needed the compressive stresses of the screw head can be distributed over a larger area of the metal by adding a washer between the head and the metal laminate 34.

The assembly as shown in FIG. 3 is also advantageous with Applicant's improved laminated bed 30 having reconstituted wood products as the intermediate laminate 36 due to the general weakness of such reconstituted wood products to local shear stressing. In the prior art structure of FIG. 5, it will be observed that the head of the toed screw 50 is buried within the bed itself and would therefore be located in the intermediate layer 36 if the prior art fastener were employed in FIG. 3. Since the wood product is not capable of absorbing substantial local loading, the toed screws would not prove useful in developing high clamping pressures that resist distortion or produce a long lasting joint of high rigidity in beds such as shown in FIG. 3.

Figure 6:
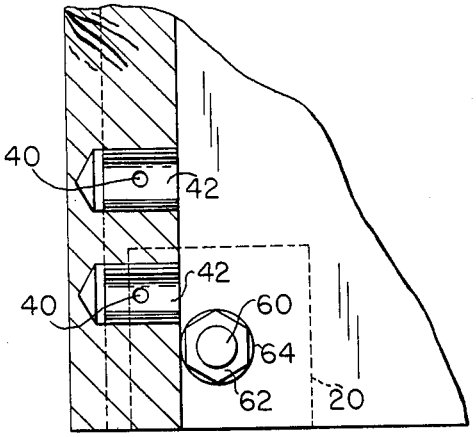
FIG. 6 is a fragmentary plan view of the arm and the key bed assembly with one of the case legs of the piano.
Figure 7:
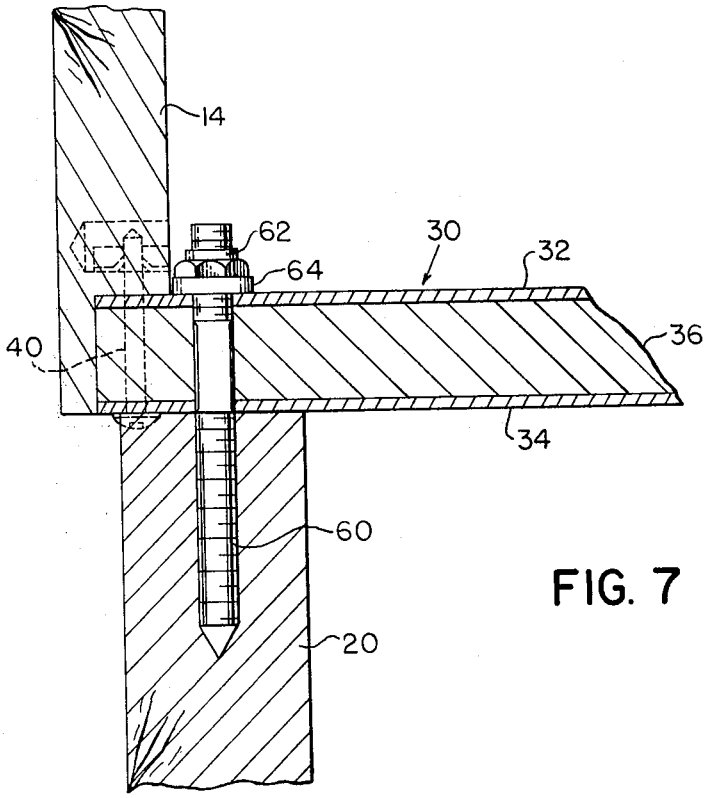
FIG. 7 is a fragmentary cross-sectional view of the arm and key bed showing the mounting of the leg in FIG. 6.

FIGS. 6 and 7 show the key bed and arm assembly including the attachment of the case leg 20. The upper end of the leg includes a lag bolt 60 which is permanently screwed into the leg and which projects upwardly through a drilled hole in the laminated bed 30. A nut 62 and a washer 64 on the upper threaded end of the lag bolt draw the leg 20 and the bed 30 into clamping relationship at the interface of the lower laminate 34 and the upper end of the leg.

The metal laminates 32 and 34 of the bed 30 provide an ideal surface for attaching the leg 20 and drawing the leg and bed into clamping relationship by means of a lag bolt 60. Large stresses associated with loads applied to the lower end of the leg 20 are distributed more evenly into the bed 30 through the metal laminates 32 and 34 when the leg bolt 60 has drawn the leg securely against the lower surface of the bed. The distribution of stresses into the bed through the metal laminates allows the leg and bed to respond to external loads in a manner resembling an integral unit.

Additionally, with the lag bolt 60 located in the vicinity of the screws, loads applied to the leg and transmitted into the bed 30 are resisted by the screws 40 and the arm 14. Consequently, if the lower end of the leg 20 is subjected to a large load such as encountered during moving of the piano when the lower end of the leg becomes caught on a rug or other obstacle, the large moment of the load is reacted at the upper end of the leg through the bed 30 and the side arm 14 so that the major structural components of the piano frame share such loading rather than the key bed itself which may possibly distort. The undercut 46 in the midportion of the shelf 38 adjacent the two front screws 40 of FIG. 4 assists the screws in absorbing the loads pushing the lower end of the leg inwardly toward the piano by allowing the moments caused by the leg to be carried more evenly, and thus at lower stress levels, by the two screws 40 at the front edge of the key bed and the single screw 40 at the rear edge of the bed. The unevenly distributed screws carry such loads more efficiently than screws distributed evenly along the end of the bed.

Accordingly, the unique assembly of the key bed and the side arm of the piano provides a front frame structure which holds the laminated key bed secure in a level position and resists warping. High clamping forces are developed on the key bed by virtue of the nut and screw fasteners. Loads applied to the frame through an attaching leg or other means are distributed through the interconnected frame members and, thus, are shared by the assembled parts at lower stress levels.

While the present invention has been described in a preferred embodiment, it should be understood that numerous modifications and substitutions can be had without departing from the spirit of the invention. For example, the numbers of screws extending through the key bed and into the side arm and their distribution along the arm may be varied in accordance with the size and expected loads to be carried by the particlar instrument in which the construction is embodied. The precise laminates illustrated in the drawings are not the only laminates with which the invention has utility; however, the metal laminates on the upper and lower surfaces of the bed are especially advantageous in Applicant's structure due to their ability to absorb the concentrated stresses that are developed by the high clamping forces in the screws 40. The bed may rest on an upwardly facing shelf in the side arm and the high clamping forces of screws are then developed between the shelf and the lower laminate of the bed. Accordingly, the present invention has been described in a preferred embodiment by way of illustration rather than limitation.

I claim:

1. An arm and key bed assembly in a piano or like instrument having a keyboard comprising:

a laminated key bed having an upper bed surface on which the keyboard of the instrument is mounted and a parallel lower surface, the laminates being securely bonded together to form a rigid bed, the outer laminates defining the upper and lower surfaces of the bed being sheet metal laminates;

an arm joined with one end of the key bed and defining a shelf against which one of said surfaces of the bed defined by the sheet metal laminates rests at the one end of the bed, a nut mounted within the arm at a position spaced from the shelf, the axis of the hole through the nut intersecting the shelf in generally perpendicular relationship; and a threaded fastening member extending through the laminated key bed and the arm generally perpendicular to the shelf and in threaded engagement with the nut for drawing said one surface of the bed defined by the sheet metal laminates and the shelf into clamping engagement at high force levels.

2. An arm and key bed assembly as defined in claim 1 wherein the arm has a rabbet groove receiving said one end of the key bed joined with the arm and one side of the groove defines the shelf against which the one of the surfaces of the key bed rests at said one end of the bed.

3. An arm and key bed assembly as defined in claim 1 wherein said one of said surfaces of the key bed resting against the shelf of the arm in clamping engagement is the upper surface of the key bed.

4. An arm and key bed assembly in a piano or like instrument as defined in claim 1 wherein the shelf of the arm includes an undercut at the midportion to define separate surfaces at the front and rear portions of the shelf against which the bed rests.

5. An arm and key bed assembly as defined in claim 4 wherein a plurality of the threaded fastening members with corresponding nuts in the arm are distributed unevenly along the end of the key bed for drawing the arm and bed together, at least two fastening members being positioned between the front edge of the bed and the undercut; and a leg of the instrument is connected to the one end of the laminated key bed adjacent the front edge.

6. An arm and key bed assembly as defined in claim 1 wherein the threaded fastening member extending through the laminated key bed and the arm is one of a plurality of such threaded fastening members for drawing the bed and the shelf into clamping engagement.

7. An arm and key bed assembly as defined in claim 1 wherein the nut within the arm is a barrel nut positioned within an access hole in the arm.

8. An arm and key bed assembly as defined in claim 1 wherein the upper surface of the laminated key bed rests against the shelf of the arm; and a leg of the piano is connected to the bed at the lower surface of the bed.

* * * * *